US009918538B2

(12) United States Patent
Lam et al.

(10) Patent No.: US 9,918,538 B2
(45) Date of Patent: Mar. 20, 2018

(54) APPARATUS AND METHOD TO REALIZE PERSONALIZED COSMETIC COMPOSITIONS

(71) Applicant: L'OREAL, Paris (FR)

(72) Inventors: Eric Wing-Jing Lam, Millbrae, CA (US); Guive Balooch, New York, NY (US); Rafal M. Pielak, Richmond, CA (US); Yunzhou Shi, San Bruno, CA (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 15/040,836

(22) Filed: Feb. 10, 2016

(65) Prior Publication Data

US 2017/0224090 A1 Aug. 10, 2017

(51) Int. Cl.
*A45D 44/00* (2006.01)
*G07F 13/06* (2006.01)

(52) U.S. Cl.
CPC ..... *A45D 44/005* (2013.01); *G07F 13/06* (2013.01)

(58) Field of Classification Search
CPC .. A45D 44/005; A45D 2044/007; G07F 13/06
USPC ..... 700/233, 239
See application file for complete search history.

(56) References Cited

U.S. PATENT DOCUMENTS 5,785,960 A * 7/1998 Rigg ..... A45D 44/005 366/160.1
6,935,386 B2 * 8/2005 Miller ..... B01F 13/1055 141/104
7,082,970 B2 * 8/2006 Bartholomew ..... A45D 44/00 141/104
7,449,342 B2 * 11/2008 Kane ..... B01F 3/18 221/224
7,555,360 B1 * 6/2009 Green ..... G07F 11/44 221/1
7,648,050 B1 * 1/2010 Ehlers ..... G07F 13/02 222/129.1
2002/0082745 A1 * 6/2002 Wilmott ..... A61K 8/044 700/233
2002/0179639 A1 * 12/2002 Bartholomew ..... A45D 44/00 222/144.5
2006/0289374 A1 * 12/2006 Alderman ..... A45D 44/005 211/85.26

FOREIGN PATENT DOCUMENTS

WO 2015/168524 A1 11/2015

* cited by examiner

*Primary Examiner* — Michael Collins
(74) *Attorney, Agent, or Firm* — Oblon, McClelland, Maier & Neustadt, L.L.P.

(57) ABSTRACT

An apparatus to realize a personalized cosmetic composition including a feeder to expose a base stored in a chamber, a dispenser to dispense a selected treatment mixture onto the base and form a treated base, a collector to collect the treated base from the chamber and depose the treated base onto a collection container, and a compacter to compact an accumulation of the treated base inside the collection container. The dispenser includes a plurality of reservoirs containing a plurality of additives to be selectively incorporated into the selected treatment mixture, wherein the plurality of additives includes a plurality of pigments to produce the selected treatment mixture in a selected of color.

11 Claims, 4 Drawing Sheets

APPARATUS AND METHOD TO REALIZE PERSONALIZED COSMETIC COMPOSITIONS

BACKGROUND

Field of the Disclosure

The present disclosure relates to realizing personalized cosmetic compositions.

SUMMARY

In one non-limiting illustrative example, an apparatus to realize personalized cosmetic compositions is presented. The apparatus to realize personalized cosmetic compositions includes a feeder to expose a base stored in a chamber, a dispenser to dispense a selected treatment mixture onto the base and form a treated base, a collector to transfer at least a portion of the treated base from the chamber to a collection container, and a compacter to compact an accumulation of the treated base inside the collection container.

In one non-limiting illustrative example, an apparatus to realize personalized cosmetic compositions is presented. The apparatus to realize personalized cosmetic compositions includes a feeder to expose a base stored in a chamber to a selected treatment mixture to form a treated base, a collector to collect the treated base from the chamber and depose the treated base onto a collection container, and a compacter to compact an accumulation of the treated base inside the collection container.

In another non-limiting illustrative example, a personalized cosmetic system is presented. The personalized cosmetic system includes circuitry configured to select a selection of additives depending on dermatological characteristics, expose a uncovered part of a base with a feeder, form a treatment mixture by blending the selection of additives with a dispenser, collect the treated base with a collector, depose the treated base to a collection container with the collector, and compact an accumulation of the treated base inside the collection container with a compacter.

In another non-limiting illustrative example, a personalized cosmetic system is presented. The personalized cosmetic system includes circuitry configured to generate additive information responsive to one or more inputs indicative of dermatological characteristics, activate a formation of a cosmetic mixture based on the generated additive information, and activate a transfer of at least a portion of the cosmetic mixture from a chamber region to a collection container.

In another non-limiting illustrative example, the circuitry is further configured to manage a density varying process responsive to one or more inputs indicative of dermatological characteristics.

In another non-limiting illustrative example, the circuitry is further configured to manage a blending of one or more additives with a base responsive to one or more inputs indicative of dermatological characteristics.

In another non-limiting illustrative example, the circuitry is further configured to manage the transfer of at least a portion of the cosmetic mixture from the chamber region to the collection container via a collector In another non-limiting illustrative example, the circuitry is further configured to generate cosmetic mixture manufacturing information.

In another non-limiting illustrative example, the circuitry is further configured to activate a transfer of at least a portion of a cosmetic mixture from a chamber region to a collection container.

In another non-limiting illustrative example, the circuitry is further configured to manage a compacting of an accumulation of a cosmetic mixture received in a collection container with a compacter.

In another non-limiting illustrative example, the circuitry is further configured to initiate a discovery protocol that allows a client device and the personalized cosmetic composition device to identify each other and negotiate one or more pre-shared keys.

In another non-limiting illustrative example, the circuitry is further configured to exchange at least one of control command information, dermatological characteristics information, cosmetic mixture manufacturing information, and additive information to a remote network.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1A:
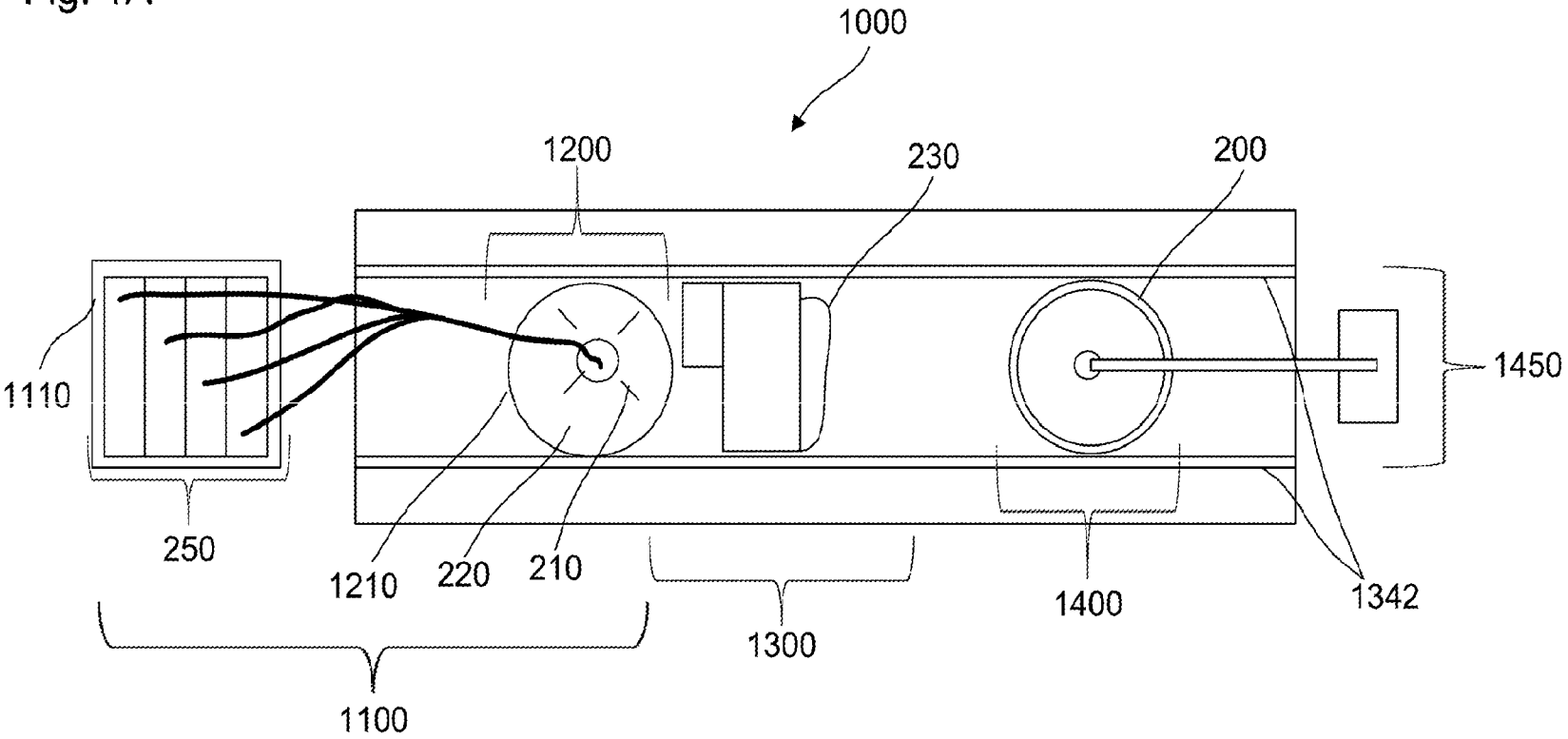
FIG. 1A is a top view of an apparatus to realize a personalized cosmetic composition, according to certain aspects of the disclosure.

All publications, patent applications, patents, and other references mentioned herein are incorporated by reference in their entirety. Further, the materials, methods, and examples discussed herein are illustrative only and are not intended to be limiting.

In the drawings, like reference numerals designate identical or corresponding parts throughout the several views. Further, as used herein, the words "a", "an", and the like include a meaning of "one or more", unless stated otherwise. The drawings are generally drawn not to scale unless specified otherwise or illustrating schematic structures or flowcharts.

Today, cosmetics and beauty products are facing an extremely diversified and demanding consumer market. Cosmetics need to address extremely specific and diversified demands from consumers. Consumers are looking for cosmetics with peculiar properties that correspond to personal demands and tastes such as certain active ingredients or scents. Further, these personal demands and tastes may vary widely from one client to another. In addition, this wide variation of demands may be influenced by parameters that are not controllable such as personal physical characteristics, ethnicities, popular styles, and weather.

In addition, cosmetics are composed of large numbers of ingredients that can be blended together with an infinite number of variations or combinations. Submerging the consumer market with a multitude of cosmetic products in a multitude of variations to make sure to address any demand from any client is then not feasible.

Thus, an apparatus and method to realize personalized cosmetic composition which can address the specific and diversified demands from clients is desired.

Accordingly, the object of the present disclosure is to provide an apparatus and a method to realize personalized cosmetic composition to address the diversified and peculiar demands of the consumers.

The apparatus of the present disclosure addresses the diversified and peculiar demands of the consumers by the delivery of a personalized cosmetic composition.

Through the proposed apparatus and method, the consumer has the ability to select and incorporate his or her own ingredients in order to create a personalized composition corresponding to the consumer's own needs. In addition, the apparatus and method enable the realization of a limitless number of variations that can be extremely well adapted to the demands of the consumer.

Figure 1B:
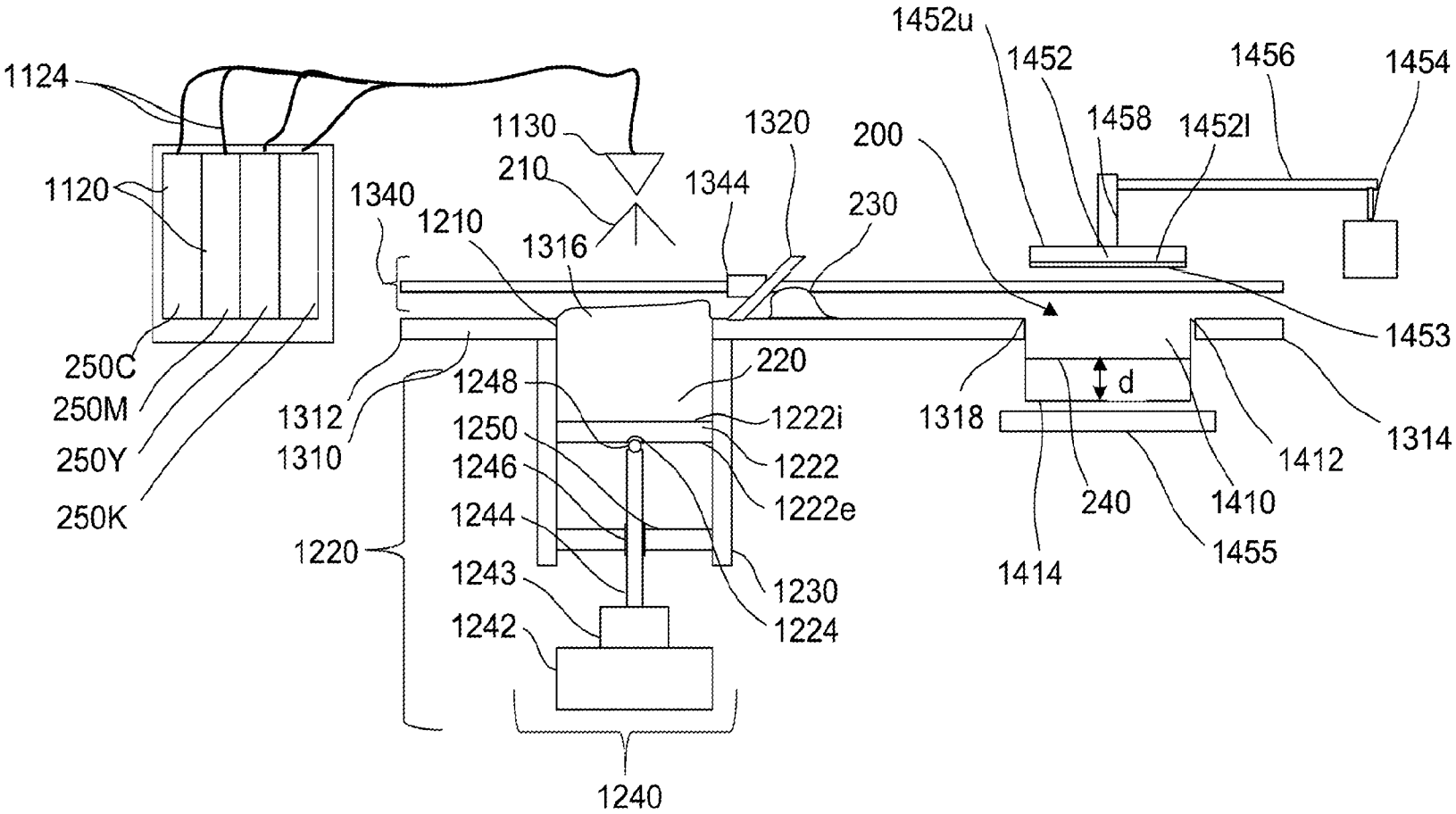
FIG. 1B is a cross sectional view of an apparatus to realize a personalized cosmetic composition, according to certain aspects of the disclosure.

FIGS. 1A-1B are a top view and a cross sectional view of an apparatus 1000 to realize a personalized cosmetic composition 200, respectively, according to certain aspects of the disclosure.

The apparatus 1000 to realize the personalized cosmetic composition 200 includes a dispenser 1100, a base container 1200, a scraper 1300, a collection container 1400, and a compacter 1450.

The dispenser 1100 dispenses a treatment mixture 210 from a main reservoir 1110 onto a base 220 (e.g., a cosmetic base, a makeup base, a powder base, a talc base, and the like) contained in the base container 1200. The treatment mixture 210 is dispensed on the base 220 to create a treated base 230. The scraper 1300 collects the treated base 230 from the base container 1200 and transports the treated base 230 onto the collection container 1400.

Once a predetermined quantity of treated base 230 has accumulated in the collection container 1400, the compressing mechanism 1450 compresses a predetermined quantity of treated base 230 to form a cake 240 inside the collection container 1400. The collection container 1400 and the cake 240 inside form the personalized cosmetic composition 200 that can be delivered to a user.

The dispenser 1100 may include the main reservoir 1110, a dispensing head 1130 that dispenses the treatment mixture 210, and a plurality of conduits 1124 that joins the main reservoir 1110 to the dispensing head 1130.

The main reservoir 1110 may include a plurality of independent reservoirs 1120 that contains a plurality of additives 250. The plurality of additives 250 may be used to elaborate the treatment mixture 210 by blending a selection of additives from the plurality of additives 250.

The plurality of additives 250 may include a plurality of compounds with specific chemical and/or physical characteristics to enhance in a personalized way the appearance and/or scent of the user. The plurality of additives 250 may include liquid binders each containing a different pigment, fragrant essential oils with different scents, different beneficial ingredients, e.g. different serums and/or skin care active ingredients.

For example, the plurality of liquid binders may include a cyan binder 250C with a cyan pigment, a magenta binder 250M with a magenta pigment, a yellow binder 250Y with a yellow pigment, and a black binder 250K with a black pigment.

In an embodiment, the apparatus 1000 generates a treatment mixture 210 responsive to one or more inputs indicative of a dermatological characteristic (e.g., characteristic associated with skin health, skin tone, skin color, skin texture, freckles, moles, scars, epidermal structures, and the like. Further non-limiting examples of dermatological characteristics include characteristic associated with photo-aging, sun-damaged, acne, ichtyosis, erythema, excoriation, hypopigmentation, hyperpigmentation, dermatitis, urticarial, allergic skin conditions, immune responses, and the like. In an embodiment, the dermatological characteristic information includes allergen information (e.g., allergen content, and allergen indication an allergen response protocol, etc.), or adverse reaction information dermatological condition. In an embodiment, the apparatus 1000 forms a personalized cosmetic composition by analyzing dermatological characteristic information to exclude ingredients, additives, and that like that cause an allergic or adverse reaction. The selection of additives to compose the treatment mixture 210 may be chosen as a function of personal dermatological characteristics of the user, such as color/tone, texture and/or and allergies of the user's skin. For example, by selecting an appropriate proportion of the cyan binder 250C, magenta binder 250M, yellow binder 250Y, and the black binder 250K the personalized cosmetic composition 200 may be created to precisely match the skin color of the user.

The selection of additives to compose the treatment mixture 210 may be selected manually via the user, automatically via software instruction performed by circuitry 3000 or the combination thereof.

The base 220 may contain fillers that can be penetrated and/or colored by the plurality of additives 250 that may be dispensed by the dispenser 1100. For example, the base 220 may be a white powder containing talc, stearic acid or/and silicon.

The dispensing head 1130 may be any kind of device configured to blend the selection of additives together to form the treatment mixture 210 and to uniformly dispense the treatment mixture 210 onto the base 220.

For example, the dispenser 1100 may be an inkjet printing system, as described in at least one of U.S. Pat. No. 6,942,324 B2 and in U.S. Pat. No. 6,938,993 B2 each of which is herein incorporated by reference.

In other alternative examples, the dispenser 1100 may be an injection valve an atomizer, or an aerosolizer configured to spread the treatment mixture 210 onto the base container 1200 through successive doses that may be less than 10 micro-liters.

The base container 1200 may include a base chamber 1230 with a base opening 1210 that faces the dispensing head 1130 and a feeder 1220 that pushes the base 220 contained inside the chamber 1230 through the base opening 1210.

The feeder 1220 may include a feeder piston 1222 inserted into the base chamber 1230 with an internal surface 1222*i* facing the base opening 1210 and in contact with the base 220. The feeder piston 1222 may be displaced along the base chamber 1230 via a feeder actuator 1240.

The feeder actuator 1240 may include a stepper motor 1242 that rotates and screws a precision screw 1244 through a fixed threaded bushing 1246. The precision screw 1244 may have a first end with a ball bearing 1248 in contact with an external surface 1222*e* of the feeder piston 1222. The external surface 1222*e* may further include a seat 1224 to receive the ball bearing 1248.

The fixed threaded bushing 1246 that may be positioned below the feeder piston 1222 and pressed fit inside a hole of a support plate 1250 affixed to the base chamber 1230. The precision screw 1244 may have a second end connected to the stepper motor 1242 via a gear box 1243, wherein the stepper motor 1242 may be located below the support plate 1250. The stepper motor 1242 rotates the precision screw 1244, the precision screw 1244 screws inside the fixed threaded bushing 1246 and is displaced vertically to push the feeder piston 1222. The displacement of feeder piston 1222 by the precision screw 1244 may be facilitated by the ball bearing 1248 that is affixed to the external surface 1222*e* of the feeder piston 1222.

The stepper motor 1242, the precision screw 1244, and the fixed threaded bushing 1246 may be configured to displace the feeder piston 1222 by a predetermined incremental distance Id, e.g. 10 microns.

For example, the stepper motor 1242 may be a position-control DC motor with a 0.007° incremental step, e.g. catalogue number 6627T3 from McMaster-Carr®, the precision screw 1244 and the fixed threaded bushing 1246 may have 100 TPI, e.g. catalogue numbers 97424A230 and 98625A350 from McMaster-Carr®, respectively.

Alternatively, the feeder actuator 1240 may rely on piezo motorized motor configured to displace the feeder piston 1222 by the predetermined incremental distance Id, such as the N-470 PiezoMike Linear Actuator from Physik Instrumente®.

In other alternative example, the feeder actuator 1240 may be mechanical, hydraulic, electrical, or pneumatic. For example, the feeder actuator 1240 may include a ball screw, a solenoid, hydraulic cylinder, pneumatic cylinder, or a combination thereof to push the feeder piston 1222 inside the base chamber 1230. Further, the feeder actuator 1240 may be manually controlled or automatically controlled via software instructions performed by the circuitry 3000. The feeder actuator 1240 may be displaced in a vertical direction, and may be connected to a linkage system.

The scraper 1300 may include a bed 1310 and a blade 1320 moveable on the bed 1310 to collect the treated base 230 and to transport the treated base 230 from the base container 1200 to the collection container 1400.

The bed 1310 may include a first end 1312, a second end 1314 connected to the collection container 1400, a first opening 1316 substantially close to the first end 1312, and a second opening 1318 substantially close to the second end 1314. The first opening 1316 faces the base opening 1210 of the base chamber 1230 while the second opening 1318 is configured to receive the collection container 1400.

The blade 1320 may be a plate flush with the bed 1310 and moveable from a first position to a second position and vice-versa via a scraper actuator 1340. In the first position the blade 1320 is positioned between the first end 1312 and the opening 1312 of the bed 1310, while in the second position the blade 1320 is positioned between the collection container 1400 and the second end 1314 of the bed 1310.

The scraper actuator 1340 may provide a longitudinal translation along an axis parallel to the bed 1310. For example, the scraper actuator 1340 may include a pair of rails 1342 and an electrical motor 1344 to linearly drive the blade 1320 along the pair of rails 1342.

The pair of rails 1342 may be spaced apart, parallel to each other and longitudinally extends from the first end 1312 to the second end 1314 of the bed 1310. The blade 1320 may be placed transversely between the pair of rails 1342 and be affixed to the motor 1344 that travels along the pair of rails 1342. In addition, the pair of rails 1342 is positioned and sufficiently spaced apart to have the blade 1320 totally covering the opening 1316 as well as the collection container 1400.

In an alternative aspect of the disclosure, the scraper actuator 1340 may be configured to displace the blade 1320 from the first position to the second position via a circular motion through a rotation around a shaft placed perpendicular to the bed 1310.

In another alternative aspect of the disclosure, the scraper actuator 1340 may be mechanical, hydraulic, electrical, or pneumatic. For example, the scraper actuator 1340 may include a rack and pinion system, a solenoid, a hydraulic cylinder, a pneumatic cylinder, or a combination thereof to move the blade 1320 from the first position to the second position and vice-versa. Further, the scraper actuator 1340 may be manually controlled or automatically controlled by software instructions performed by the circuitry 3000.

In another alternative aspect of the disclosure, the blade 1320 and the scraper actuator 1340 may be replaced by a nozzle and blowing system that blows the treated base 230 from the base opening 1210 to the collection container 1400. Additionally, and the scraper actuator 1340 may be replaced by a conveyor belt placed on top of the bed 1310 and actuated by a plurality of rollers.

In another alternative aspect of the disclosure, the blade 1320 and/or the bed 1310 may include asperities to enhance the mixing between the treatment mixture 210 and the base 220 while the treated base 230 is displaced from the first position to the second position. The asperities may be ridges, grooves or tongues forming geometrical patterns such as herringbones.

The collection container 1400 may include a mouth 1412, a closed bottom 1414 and a collection chamber 1410 that receives the treated base 230 carried by the feeder 1220.

The collection container 1400 may be configured to be detachable from the second end 1314 of the bed 1310 in order for the user to carry the cake 240 inside the collection container 1400. In addition, the mouth 1412 may be configured to receive a lid to close the collection container 1400 and facilitate the transportation of the personalized cosmetic composition 200.

The compacter 1450 may include a compacter piston 1452, a rod 1458, a lever 1456, a base support 1455 to provide support to the collection container 1400, and a compacter actuator 1454. The compacter piston 1452 may include a lower surface 14521 facing the collection container 1400 and an upper surface 1452*u* affixed to the rod 1458. The lever 1456 may include a first extremity 1456*a* connected to the upper surface 1452*u* through the rod 1458 and a second extremity 1456*b* connected to the compacter actuator 1454.

The compacter 1450 may be configured to induce a predetermined compacting load on the treated based 230 contained in the collection chamber 1410 and form the cake 240. The compacter 1450 may displace the compacter piston 1452 from an upper position to a lower position via the compacter actuator 1454 while the collection container 1400 is maintained fixed by the base support 1455. The displacement of the compacter piston 1452 induces a predetermined load on the treated base 230 contained in the collection chamber 1410 to form the cake 240.

In the upper position, the compacter piston 1452 is located above the second end 1314 of the bed 1310 while in the lower position the compacter piston 1452 is inserted inside the collection chamber 1410 and located at a predetermined compacting distance d from the enclosure 1414 of the collection chamber 1410. The predetermined compacting distance d may be adjusted depending on the quantity of the personalized cosmetic composition 200 and/or a compactness of the cake 240.

In addition, a porous layer 1453 configured to absorb excess liquid present in the collection chamber 1410 by capillarity may be provided on the lower surface 14521 of the compacter piston 1452.

The compacter actuator 1454 may be manual, mechanical, hydraulic, electrical, pneumatic, or the combination thereof. For example, the compacter actuator 1454 may include a solenoid, a hydraulic cylinder, a pneumatic cylinder, or a combination thereof. Further, the compacter actuator 1454 may be manually controlled or automatically controlled via software instructions performed by the circuitry 3000.

Figure 2:
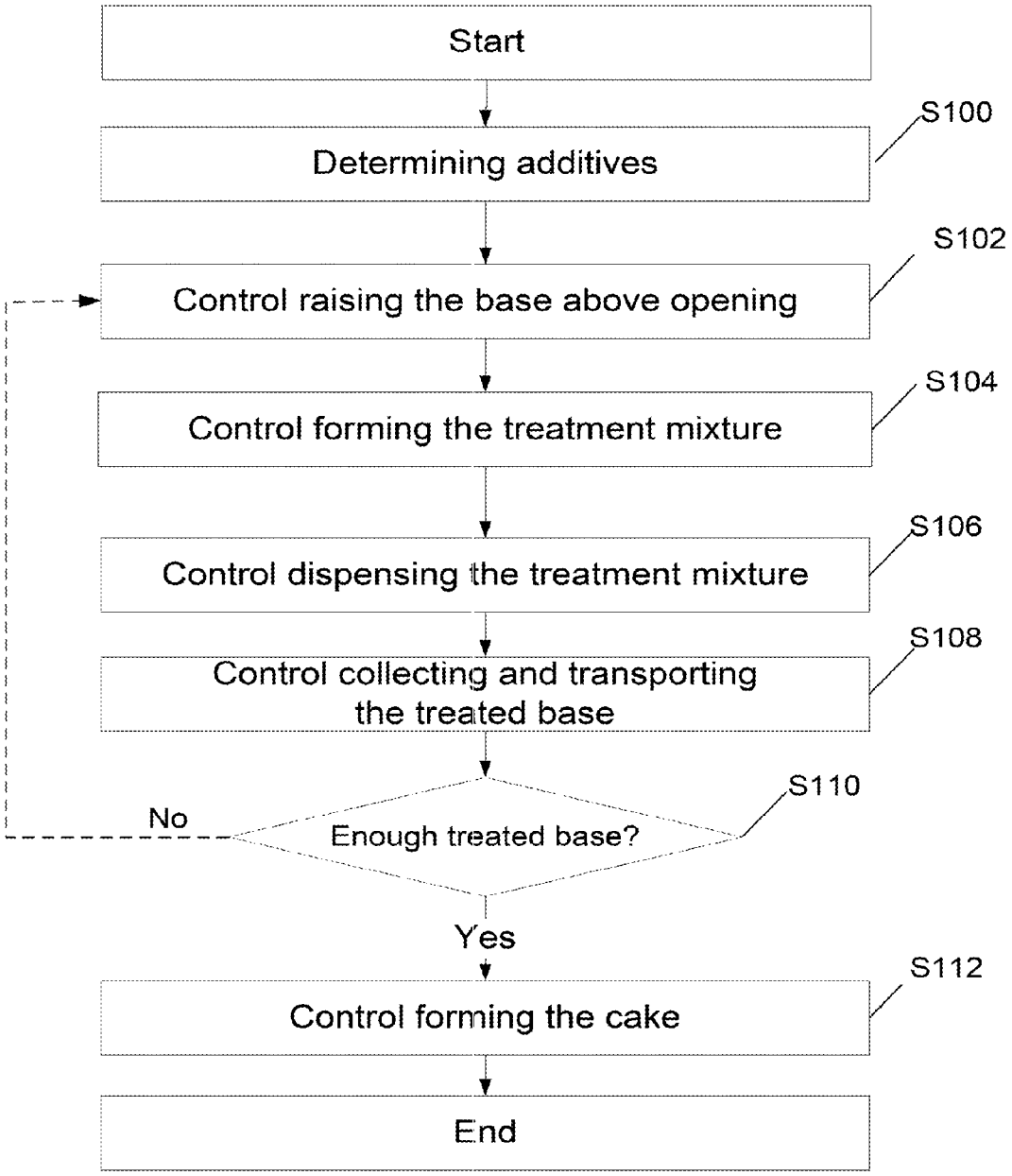
FIG. 2 is a chart flow of a method for realizing the personalized cosmetic composition, according to certain aspects of the disclosure.

FIG. 2 depicts a method to realize the personalized cosmetic composition 200 through the apparatus 1000.

In a step S100, the determination of additives composing the treatment mixture 210 is performed. For each additive of the plurality of additives 250 a quantity is determined. The quantity for each additive 250 may be chosen as a function of personal dermatological characteristics of the user, (e.g., compound information, color information, specific chemical and/or physical characteristic information, liquid binder information, pigment information, fragrance information, serum information, active ingredient information, and the like). For example, a first quantity of the cyan binder 250C, a second quantity of the magenta binder 250M, a third quantity of the yellow binder 250Y, and a fourth quantity of the black binder 250K may be determined to match the skin color of the user. This determination may be performed manually by an input from the user, automatically via software instruction performed by the circuitry 3000, or the combination thereof.

Figure 3:
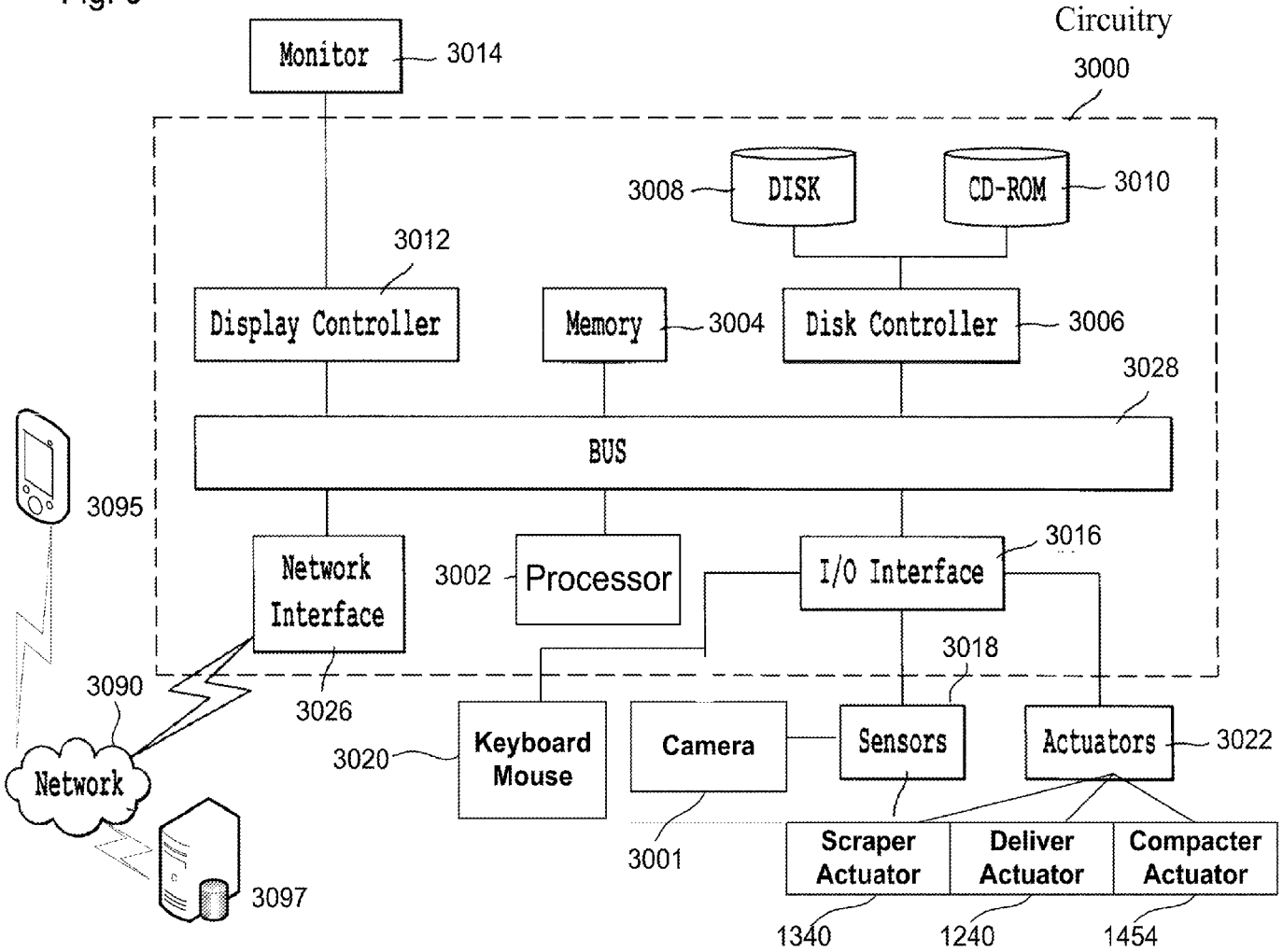
FIG. 3 is a schematic view of a hardware diagram of circuitry for operating the apparatus, according to certain aspects of the disclosure.

For example, images of the skin of the user may be captured by a camera 3001 of the circuitry 3000, see FIG. 3. From these images a red component, a green component, and a blue component of the skin color can be extracted and converted into a quantity of cyan, a quantity of magenta, a quantity of yellow, and a quantity of black to reproduce the skin color of the user.

Alternatively, cosmetic mixture manufacturing information (e.g., mass, volume, weight, content, height, date, threshold quantity, additive content, or the like) may be inputted on the apparatus 1000. This input may be performed manually by the user, automatically via software instructions performed by the circuitry 3000 or the combination thereof. For example, the user may input the cosmetic mixture manufacturing information through input devices (e.g., keyboard or touchscreen) that may be connected to an I/O interface 3016 as peripherals, as part of the circuitry 3000, or from external device such as a client device or mobile device connected to the apparatus via a network 3024 (e.g., the Internet or a local intranet), connected to the circuitry 3000 via a network interface 3026 as will be described below.

Alternatively, the circuitry 3000 may manage and control a density varying process responsive to one or more inputs indicative of dermatological characteristics.

Alternatively, the circuitry 3000 may manage and control a blending of one or more additives with a base responsive to one or more inputs indicative of dermatological characteristics.

In a step S102, the base 220 is raised or exposed to the dispenser 1100. The base 220 may be raised by actuating the feeder 1220. For example, the feeder actuator 1240 may be operated to displace the feeder piston 1222 and force the base 220 out of and above the base opening 1210. More precisely, the feeder piston 1222 may be displaced for a predetermined distance to expose a predetermined quantity of the base 220.

The step S102 may be performed manually by the user or automatically by software instructions executed by the circuitry 3000. For example, the circuitry 3000 may send a predetermined number of current impulses to the step motor 1242 for displacing the feeder piston 1222 of the predetermined distance. This displacement may be verified by a sensor (not shown) or by detecting the position of at least one of a gear of the stepper motor 1242 with an optical encoder.

In a step S104, the apparatus performs control to form and dispense the treatment mixture 210 onto the base 220. The treatment mixture 210 is formed by blending the additives of the plurality of additives 250 with quantities selected in the step S100. Such blending of the additives 250 may be performed by the dispenser 1100, which may be operated following software instructions executed by the circuitry 3000.

In a step S106, the treatment mixture 210 prepared in the step S104, is controlled to be dispensed onto the base 220 that has been exposed in step S101 at a predetermined dose via the dispenser 1100, which may be operated following software instructions executed by the circuitry 3000. The dispensing of the treatment mixture 210 on the exposed base 220 forms the treated base 230.

In a step S108, at least a portion of the treated base 230 formed in the step S106 is collected and transported by the scraper 1300 from the base container 1200 to the collection container 1400. The blade 1320 may be moved from the first position to the second position via the scraper actuator 1340.

The step S108 may be performed manually by the user or automatically by software instructions executed by the circuitry 3000. The scraper actuator 1340 may be actuated manually or automatically by software instructions executed by the circuitry 3000. For example, the circuitry 3000 may feed the electrical motor 1344 with a current during a predetermined period of time to displace the blade 1320 from the first position to the second position.

In a step S110, it is determined if the quantity of treated base 230 accumulated in the collection container is sufficient. This determination may be performed by verifying that the quantity of base 220 pushed through the base opening 1210 is higher than a predetermined threshold. For example, the quantity of base 220 pushed through the base opening 1210 may be evaluated by measuring a total displacement of the feeder piston 1222. This displacement may be measured by a sensor (not shown) or by detecting the position of at least one of a gear of the stepper motor 1242 with an optical encoder.

If it is determined that treated base 230 accumulated in the collection container 1400 is insufficient, the process goes to the step S102. Otherwise, the process goes to a step S112. Alternatively, if only a portion of the treated base was initially transferred to the collection container by the scraper, then all or some of a remaining portion of the treated base may be transferred to the collection container without repeating the process from step S102.

In the step S112, the cake 240 is formed via the compacter 1450. The treated base 230 accumulated inside the collection container 1400 are compressed by displacing the compacter piston 1452 from the upper position to the lower position. The displacement of the compacter piston 1452 is performed by actuating the compacter actuator 1454.

The step S112 may be performed manually by the user or automatically by software instructions executed by the circuitry 3000. The compacter actuator 1454 may be actuated by software instructions executed by the circuitry 3000. For example, the circuitry 3000 may feed the electrical motor 1344 current during a predetermined period of time to displace the compacter piston 1452 from the upper position to the lower position.

FIG. 3 depicts the circuitry 3000 that may control the apparatus 1000, according to certain aspects of the disclosure. As shown in FIG. 3, systems, operations, and processes in accordance with this disclosure may be implemented using a processor 3002 or at least one application specific processor (ASP). The processor 3002 may utilize a computer readable storage medium, such as a memory 3004 (e.g., ROM, EPROM, EEPROM, flash memory, static memory, DRAM, SDRAM, and their equivalents), configured to control the processor 3002 to perform and/or control the systems, operations, and processes of this disclosure. Other storage mediums may be controlled via a disk circuitry 3006, which may control a hard disk drive 3008 or optical disk drive 3010.

The processor 3002 or aspects thereof, in an alternate embodiment, can include or exclusively include a logic device for augmenting or fully implementing this disclosure. Such a logic device includes, but is not limited to, an application-specific integrated circuit (ASIC), a field programmable gate array (FPGA), a generic-array of logic (GAL), and their equivalents. The processor 3002 may be a separate device or a single processing mechanism. Further, this disclosure may benefit form parallel processing capabilities of a multi-cored processor.

In another aspect, results of processing in accordance with this disclosure may be displayed via a display controller 3012 to a monitor 3014 that may be peripheral to or part of the circuitry 3000. Moreover, the monitor 3014 may be provided with a touch-sensitive interface to a command/instruction interface. The display controller 3012 may also include at least one graphic processing unit for improved computational efficiency. Additionally, the circuitry 3000 may include an I/O (input/output) interface 3016, provided for inputting sensor data from sensors 3018, such as the camera 3001, and for outputting orders to actuators 3022, such as the compacter actuator 1454, the scraper actuator 1340, and the feeder actuator 1240. The sensors 3018 and actuators 3022 are illustrative of any of the sensors and actuators described in this disclosure.

Further, other input devices may be connected to an I/O interface 3016 as peripherals or as part of the circuitry 3000. For example, a keyboard or a pointing device such as a mouse 3020 may control parameters of the various processes and algorithms of this disclosure, and may be connected to the I/O interface 3016 to provide additional functionality and configuration options, or to control display characteristics. Actuators 3022 which may be embodied in any of the elements of the apparatuses described in this disclosure may also be connected to the I/O interface 3016.

The above-noted hardware components may be coupled to the network 3024, such as the Internet or a local intranet, via a network interface 3026 for the transmission or reception of data, including controllable parameters to a mobile/client device 3095. For example, control command information, dermatological characteristics information (e.g., compound information, color information, specific chemical and/or physical characteristic information, liquid binder information, pigment information, fragrance information, serum information, active ingredient information, and the like), cosmetic mixture manufacturing information (e.g., mass, volume, weight, content, height, date, threshold quantity, additive content, and the like), and additive information may be transmitted and/or received from device 3095 via the network 3024 to the apparatus 1000 and vice versa. Additionally, all input/output operations, control operations, and display operations described above as being performed locally at the apparatus 1000 may be performed remotely by the device 3095. Furthermore, the circuitry 3000 of the apparatus 1000 may initiate a discovery protocol that allows the device 3095 and the apparatus 1000 to identify each other and negotiate one or more pre-shared keys.

Alternatively, the circuitry 3000 is further configured to generated and/or exchange at least one of control command information, dermatological characteristics information, cosmetic mixture manufacturing information, and additive information to a server 3097 in a remote network or to the device 3095. This information may be used to help store details of the cosmetic mixture in association with the particular user.

A central BUS 3028 may be provided to connect the above-noted hardware components together, and to provide at least one path for digital communication there between.

The foregoing discussion discloses and describes merely exemplary embodiments of an object of the present disclosure. As will be understood by those skilled in the art, an object of the present disclosure may be embodied in other specific forms without departing from the spirit or essential characteristics thereof. Accordingly, the present disclosure is intended to be illustrative, but not limiting of the scope of an object of the present disclosure as well as the claims.

Numerous modifications and variations on the present disclosure are possible in light of the above teachings. It is therefore to be understood that within the scope of the appended claims, the disclosure may be practiced otherwise than as specifically described herein.

What is claimed is:

1. An apparatus to realize a personalized cosmetic composition, comprising:
- a chamber;
- a base compound stored into the chamber;
- a feeder to expose the base compound;
- a dispenser to spread a selected treatment mixture onto the base compound, wherein
  - the selected treatment mixture penetrates an upper portion of the base compound to modify dermatological properties of the upper portion of the base compound and form a treated base, and to leave a lower portion of the base compound unmodified;
- a collector to transfer at least a portion of the treated base from the chamber to a collection container; and
- a compacter to compact an accumulation of the treated base inside the collection container.

2. The apparatus of claim 1, wherein the dispenser includes a plurality of reservoirs containing a plurality of additives to be selectively incorporated into the selected treatment mixture.

3. The apparatus of claim 2, wherein the plurality of additives includes a plurality of pigments to produce the selected treatment mixture in a selected of color.

4. The apparatus of claim 3, wherein the plurality of pigments includes a cyan pigment, a magenta pigment, a yellow pigment, and a black pigment.

5. The apparatus of claim 1, wherein the feeder further includes a piston to push the base compound through an opening of the chamber.

6. The apparatus of claim 5, wherein the feeder pushes the piston in incremental steps with a feeder actuator.

7. The apparatus of claim 1, wherein the collector further includes a blade moveable from a first end of a bed to a second end of the bed, wherein the chamber and the collection container are positioned between the first end of the bed and the second end of the bed.

8. The apparatus of claim 7, wherein the bed has asperities to enhance mixing between the base compound and the selected treatment mixture while the treated base is transferred from the first end of the bed to the second end of the bed.

9. The apparatus of claim 1, wherein the compacter further includes a piston moveable from an upper position to a lower position, wherein in the lower position the piston is in contact with the accumulation of treated base and in the upper position the piston is not in contact with the accumulation of treated base.

10. The apparatus of claim 9, wherein the piston includes a porous layer to absorb excess liquid present in the accumulation of the treated base.

11. The apparatus of claim 1, wherein dermatologic properties includes skin colors.

* * * * *